United States Patent [19]

Lunsford et al.

[11] 3,992,128

[45] Nov. 16, 1976

[54] VARIABLE DIFFUSER

[75] Inventors: Jimmy L. Lunsford, Plainfield; Harry N. Nelson, Indianapolis, both of Ind.

[73] Assignee: General Motors Corporation, Detroit, Mich.

[22] Filed: June 9, 1975

[21] Appl. No.: 585,344

[52] U.S. Cl. ..... 415/161

[51] Int. Cl.[2] ..... F04D 27/02

[58] Field of Search ..... 415/149 R, 160, 161, 415/162, 163, 164

[56] References Cited

UNITED STATES PATENTS

| | | | |
|---|---|---|---|
| 22,901 | 2/1859 | Temple | 415/161 |
| 74,455 | 2/1868 | Trullinger | 415/161 |
| 1,544,288 | 6/1925 | Ormer | 415/149 R |
| 2,337,861 | 12/1943 | Adamtchik | 415/161 |
| 2,648,195 | 8/1953 | Wilde et al. | 415/161 |
| 3,588,270 | 6/1971 | Bocks | 415/149 R |
| 3,799,694 | 3/1974 | Duzan | 415/149 R |

FOREIGN PATENTS OR APPLICATIONS

| | | | |
|---|---|---|---|
| 710,346 | 9/1941 | Germany | 415/161 |
| 151,440 | 3/1932 | Switzerland | 415/161 |
| 893,054 | 4/1962 | United Kingdom | 415/161 |

*Primary Examiner*—Henry F. Raduazo
*Attorney, Agent, or Firm*—Paul Fitzpatrick

[57] ABSTRACT

A diffuser for a centrifugal compressor has an annular array of vanes which are movable to vary the configuration of the diffusing passages between the vanes. Each vane includes a first leaf pivoted adjacent the leading edge of the vane and a second leaf pivoted on the first leaf. These leaves have slots extending chordwise of the vanes which are engaged by pins extending from an actuating ring rotatable about the axis of the diffuser. The slots in the two leaves are at an angle to each other so that when the ring is rotated and the pins move chordwise of the vanes in the leaves, the angle of the first leaf to the radial direction is changed and also the second leaf is moved relative to the first leaf to vary the width of the passage in addition to such variation as results from the change in the angle of the first leaf.

4 Claims, 7 Drawing Figures

VARIABLE DIFFUSER

Our invention relates to diffusers for compressors including centrifugal or radial-flow compressors and is directed to diffuser structures of variable configuration adapted to provide efficient diffusion at varying rates of flow. Such diffusers are particularly desirable for use in gas turbine engines having widely varying output requirements, since the change in configuration of the diffuser promotes a higher level of efficiency over a wide range of flow through the compressor.

The principal objects of our invention are to provide a diffuser adaptable to varying rates of flow, to provide a diffuser in which the settings of the vanes are variable so as to achieve the optimum diffuser exit to inlet area ratio for varying flow conditions by changing the direction of flow and divergence of the passages. More particularly, it is an object of the invention to provide such a diffuser of the radial-flow type. A further object is to provide a variable diffuser having simple and reliable structure and an improved mode of actuation.

The nature of the invention and its advantages will be apparent to those skilled in the art from the succeeding detailed description of the preferred embodiment of the invention and the accompanying drawings thereof.

Figure 1:
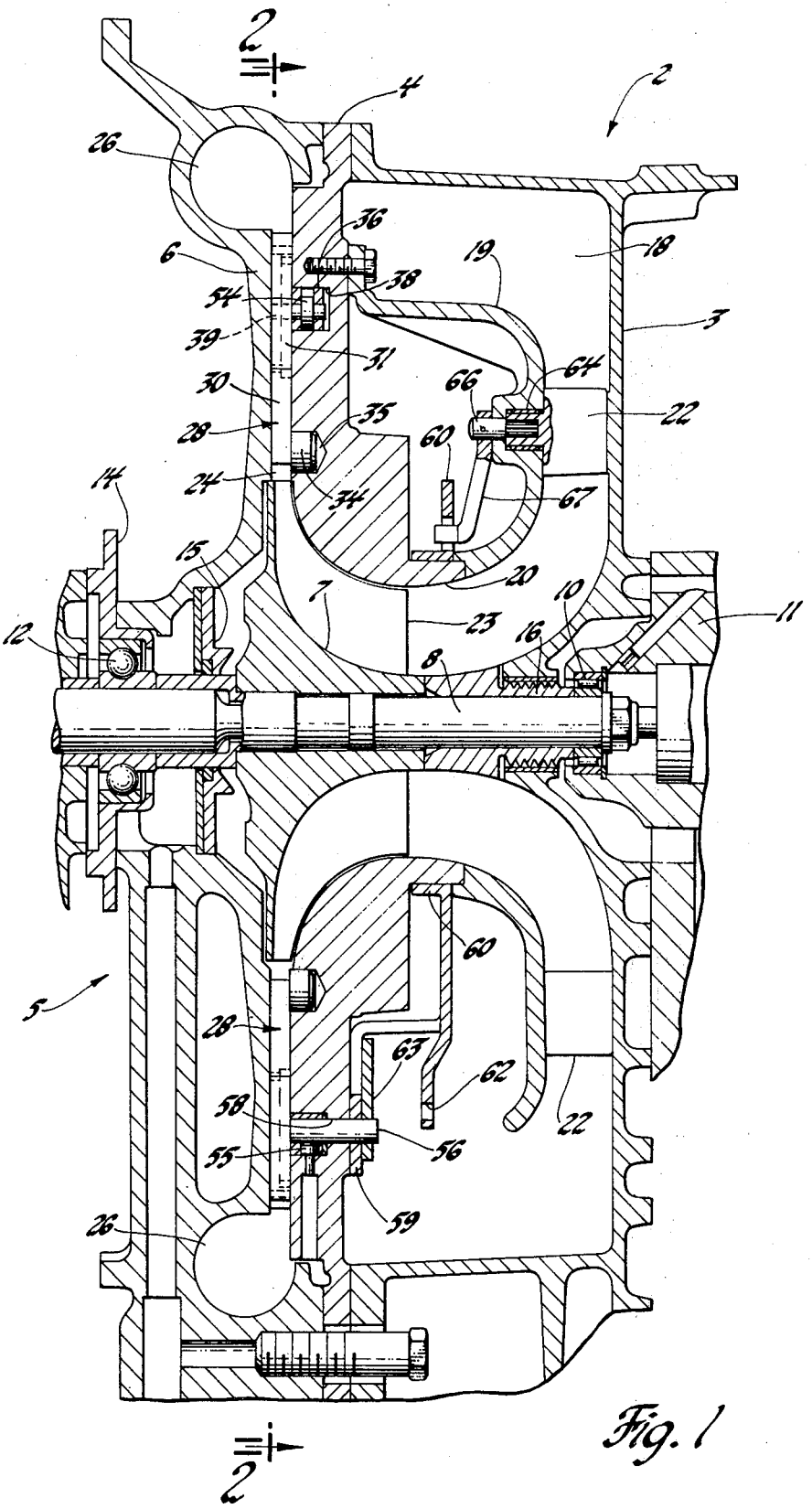
FIG. 1 is a longitudinal sectional view of a centrifugal compressor taken in a plane containing the axis of rotation of the compressor rotor.

FIG. 1 illustrates a compressor embodying the invention as it might appear installed in an automotive gas turbine engine. Details of the engine are immaterial to the present invention, but by way of background it may be pointed out that engines of this sort are described in U.S. Pat. Nos. as follows: Collman et al. 3,077,074, Feb. 12, 1963 and Bell 3,490,746, Jan. 20, 1970.

Referring first to FIG. 1, the engine housing or frame 2 may include a plate 3, a diffuser front wall 4, and diffuser rear wall 6. These are generally annular bodies bolted together at peripheral flanges. The radial-flow compressor 5 includes a rotor or impeller 7 fixed to a shaft 8. This shaft is supported in a bearing 10 mounted in a housing 11 bolted to the plate 3. It is supported in a thrust bearing 12 mounted in a support 14 fixed to the rear wall 6. Oil seal are provided at 15 and 16.

Air is admitted through a suitable intake into an intake chamber 18 between the plate 3 and wall 4. This chamber is bounded on its inner side by an air inlet outer shroud ring 19. The outer margin of this ring is bolted and dowelled to the wall 4 and the inner margin mates with the forwardly extending flange 20 of wall 4. Flange 20 is the forward or inner end of the portion of wall 4 which defines a fixed shroud for the compressor rotor 7. Air flows from the chamber 18 radially inward through a row of adjustable setting inlet guide vanes 22 into the inlet eye 23 of the impeller. The impeller discharges the air into a diffuser 24 extending radially outward from the periphery of the impeller between walls 4 and 6 to a scroll or collection chamber 26 from which the air is delivered through a regenerator to the combustion chamber of the engine.

The significant subject matter of the present invention lies principally in the variable vanes 28 which are shown most clearly in the remaining figures of the drawings.

Figure 2:
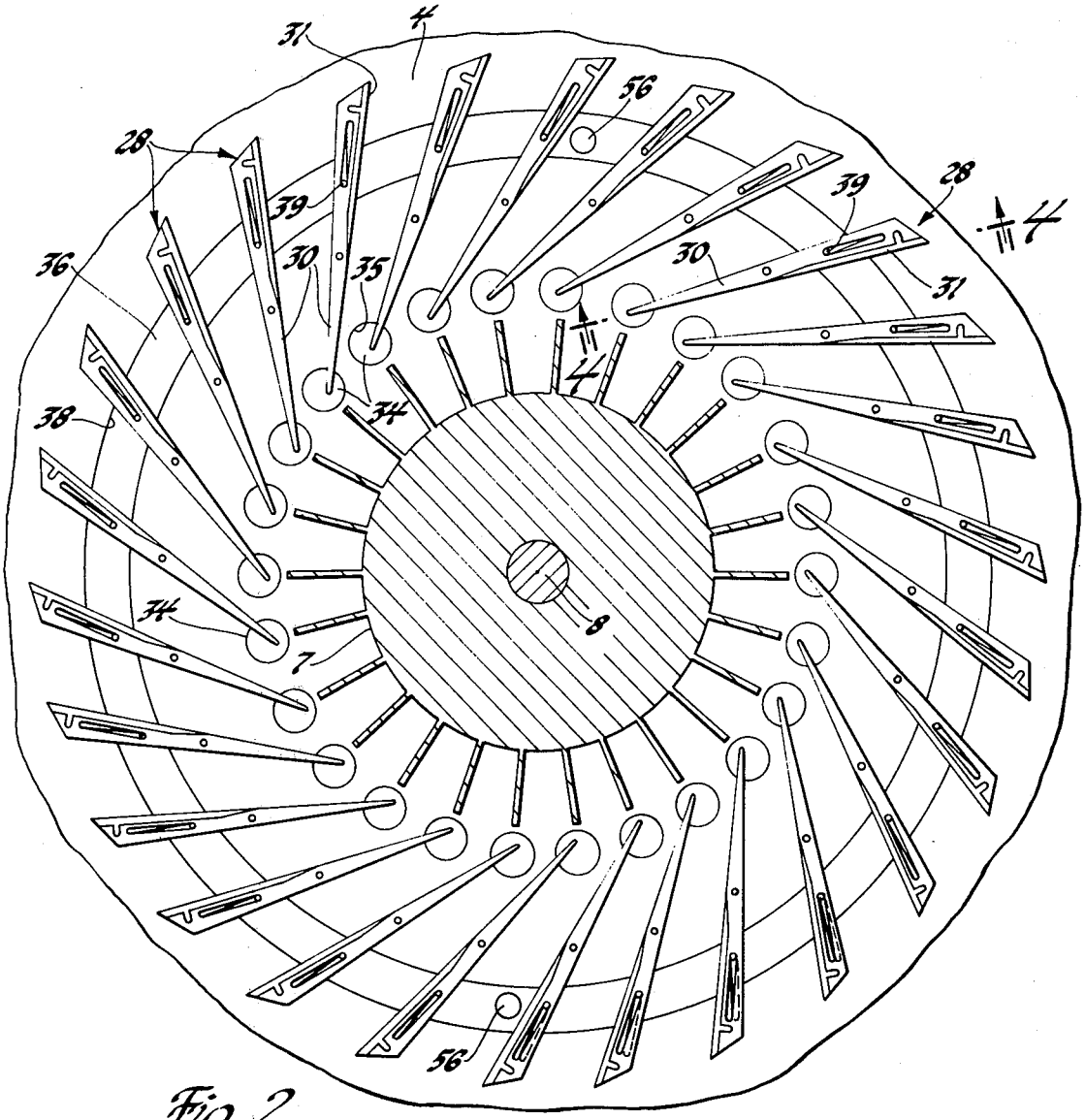
FIG. 2 is a transverse sectional view taken on the plane indicated by the line 2—2 in FIG. 1 showing the maximum flow configuration of the diffuser.
Figure 3:
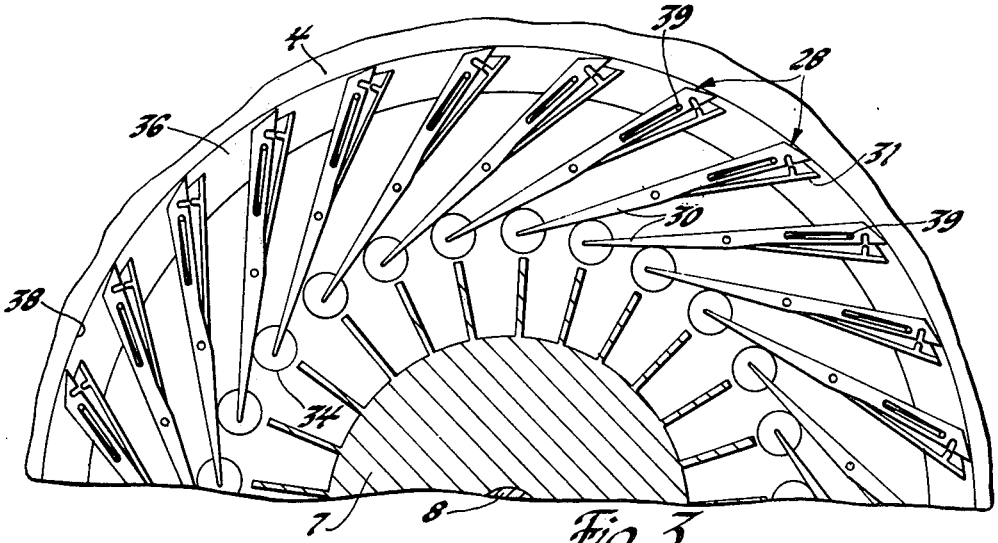
FIG. 3 is a partial view similar to FIG. 2 but illustrating the minimum flow configuration of the diffuser.
Figure 4:
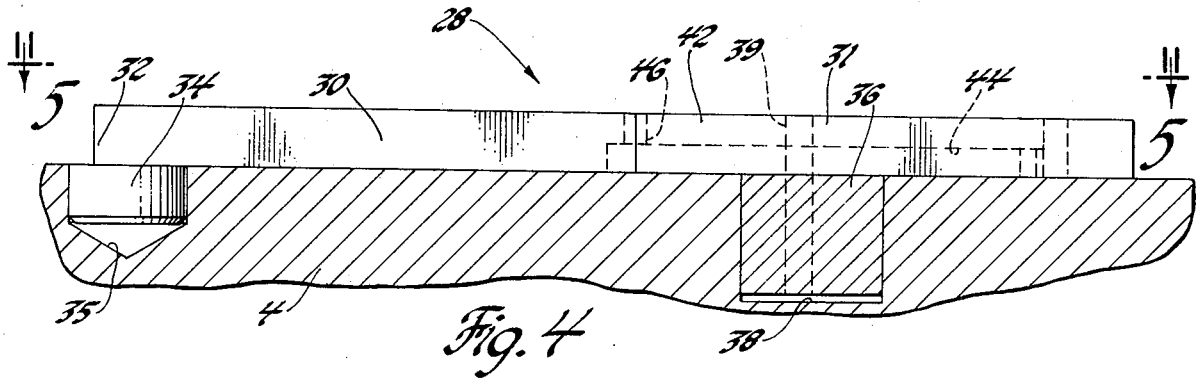
FIG. 4 is a partial sectional view taken on the plane indicated by the line 4—4 in FIG. 2.
Figure 5:
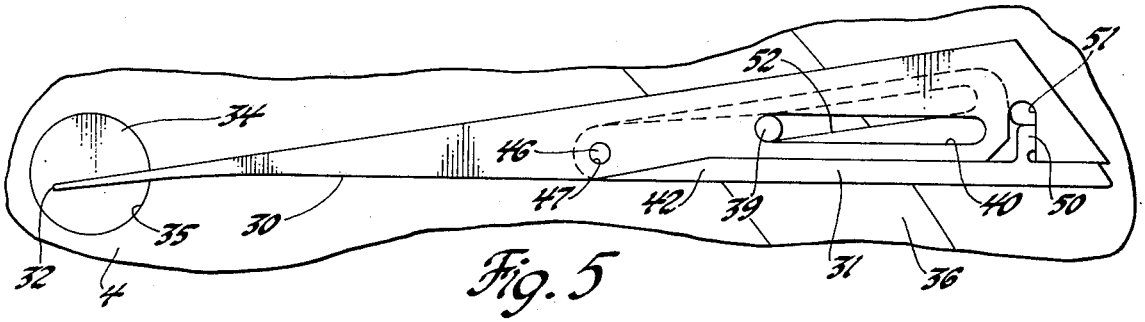
FIG. 5 is a fragmentary elevation view, taken on the plane indicated by the line 5—5 in FIG. 4, showing a vane in the maximum flow position.

Each variable vane 28 comprises a first or main leaf 30 and a second or supplementary leaf 31. The first leaf has a thin leading edge at 32 and the leading portion of the vane is brazed, welded, or otherwise fixed to a cylindrical plug 34 which is rotatably fitted into a bore or recess 35 in the wall 4. The first leaf 30 thus swings about the axis of plug 34 when it is moved by an actuating ring 36 which is mounted in an annular recess 38 in the wall 4 for rotation about the axis of shaft 8. Ring 36 has mounted in it axially extending pins 39, one for each of the 26 vanes 28. Pin 39 coacts with ramp means defined by the walls of a slot 40 in the leaf 30. The walls of this slot provide a cam and follower connection from the ring 36 and pins 39 to the leaves 30. In FIGS. 2 and 5 the pins 39 are at the end of the slot nearer the leading edge of the vane, and in FIGS. 3 and 6 they are shown at the outer or downstream end of the slot. Rotation of the ring 36 between these two positions causes the leaf 30 to adopt a greater angle to the radial direction and also swings the leaves closer together, reducing the area of the discharge path from the compressor.

The second leaf, which further adjusts the configuration of the diffusing passage, comprises a plate portion 42 which defines the surface of the vane 28. It also includes a web 43 integral with the plate 42. The plate 42 bears against the lower surface of leaf 30 in the condition illustrated in FIG. 5 and the web 43 is received in a recess 44 in the side face of leaf 30. Leaf 31 is rotatably connected to leaf 30 by a hinge pin 46 which is inserted in a bore 47 extending axially of the compressor through the leaf 30.

It will be noted that the leading edge 48 of plate 42 is wedge-shaped and that it fits in a correspondingly inclined surface of the leaf 30. The leading edge 48 is immediately adjacent the hinge pin 46.

Leaf 31 also includes a transverse rib 50 which is received in a recess 51 in leaf 30 when the webs of the vane are closed together as in FIG. 5.

Figure 6:
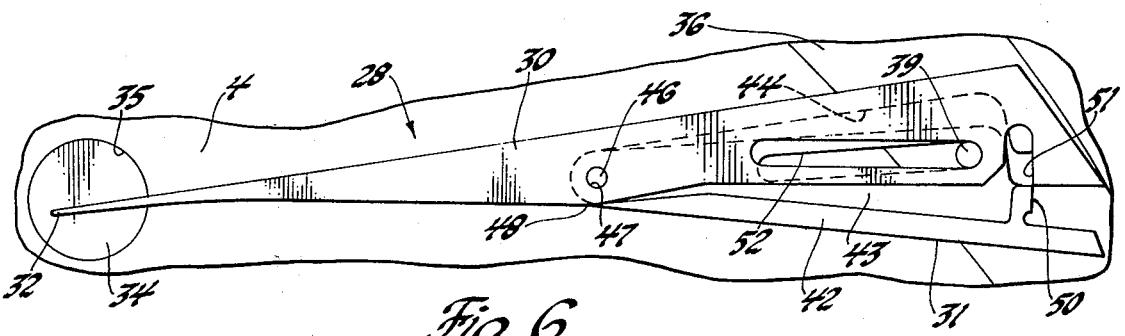
FIG. 6 is a view similar to FIG. 5 showing a vane in the minimum flow position.
Figure 7:
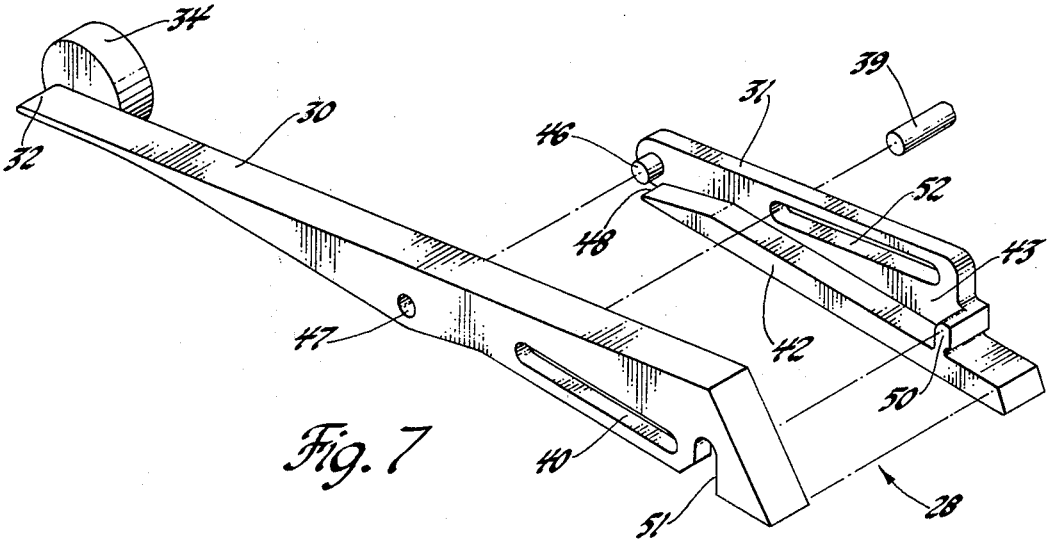
FIG. 7 is an exploded axonometric view of a vane.

The second leaf 31 includes ramp means defined by a slot 52 which, as will be apparent from FIGS. 5 and 6, is at a diverse angle from the slot 40 in the first leaf. As a result, as the pin 39 moves from the leading edge of the vane the leaves are spread from each other about the hinge axis at 46. The vane is thus broadened toward its trailing edge and the passages between the vanes accordingly contracted. The angle of divergence of the diffusing passage is thus decreased when the vanes are in the low flow position of FIGS. 3 and 6.

The actuating ring may be supported for free movement in the recess 38 by circumferentially spaced rollers 54 rolling on the inner surface of recess 38. It may be located axially by rollers 55 rotatable about radial axes and engaging in circumferential slots extending part way around the outer periphery of the ring 36. These details are immaterial to the invention, however, as are the means for rotating the ring 36.

The ring is rotated by two drive pins 56 (FIG. 1), only one of which is illustrated, which are approximately diametrically spaced and extend forwardly from the ring 36 through slots 58 in the front wall 4. The pins 56 are moved by arms 59 extending from an actuating ring 60 journaled for rotation on the forward portion 20 of wall 4. This ring may be rotated by a suitable actuator connected to an eye 62 on an arm extending from ring 60. Movement of the ring 60 and ring 36 may be limited by a stop plate 63.

Ring 60 also is connected to actuate the inlet guide vanes 22 which are journaled in bearings 64 in the ring 19. The hub or shaft of each vane is fixed to a shaft 66, in turn fixed to an arm 67 which engages within a slot in the ring 60 for rotation of the inlet vanes 22.

It will be seen from the foregoing that by connection of any suitably controlled actuator to the eye 62 on ring 60 to rotate the ring the vanes 22 and 28 may be rotated about their mounts and the vanes 28 may be spread to vary the air flow capacity of the compressor. The apparatus for control of the movement of such an actuator is immaterial to our invention and, therefore, will not be described.

It should be apparent that the principles of the invention can be applied to diffusers of other types, such as axial-flow diffusers, with suitable modification of structure. In an axial-flow diffuser the vanes would extend radially between outer and inner walls and rotate about radiating axes. Rotation of an actuating ring circumferentially of the diffuser would correspond to circumferential movement in FIGS. 1 to 3 if the setting of the vanes is appropriate for such movement. Also, an actuating ring could move longitudinally of an axial-flow diffuser.

The detailed description of the preferred embodiment of the invention for the purpose of explaining the principles thereof is not to be considered as limiting or restricting the invention, since many modifications may be made by the exercise of skill in the art.

We claim:

1. A diffuser for radial gas compressor comprising, in combination, means providing mutually spaced radial walls defining between them an annular space for diffusion of flow from a compressor rotor to an outlet; an annular cascade of variable-configuration vanes each extending between the said walls and extending downstream from a leading edge adjacent the gas entrance to the said space and defining diffusing passages between adjacent vanes; and an actuating ring extending about the axis of the diffuser movable for varying the configuration of the vanes, in which the improvement comprises a structure of each vane including a first leaf extending downstream from the leading edge pivotally mounted on the first-recited means adjacent the vane leading edge; a second leaf pivotally mounted on the first leaf adjacent the leading edge of the second leaf and extending downstream approximately to the termination of the first leaf; each leaf including ramp means extending in a direction from the leading toward the trailing edge of the leaf, the ramp means on the second leaf being oblique to that on the first leaf so that movement of a driving means along the ramp means rotates the first leaf around it pivotal mounting and rotates the second leaf around its pivotal mounting on the first leaf so as to vary the relative angle of the leaves, thus varying the dimensional parameters of each said diffusing passage; the actuating ring including driving means in engagement with the said ramp means.

2. A diffuser for a centrifugal compressor comprising, in combination, means providing mutually spaced radial front and rear walls defining between them an annular space for diffusion of flow from a compressor rotor to an outlet; an annular cascade of variable-configuration vanes each extending between the said walls and extending from a leading edge adjacent the inner margin of the said space generally tangentially and radially outward and defining diffusing passages between adjacent vanes; and an actuating ring rotatable about the axis of the diffuser for varying the configuration of the vanes, in which the improvement comprises a structure of each vane including a first leaf extending downstream from the leading edge pivotally mounted on the first-recited means adjacent the vane leading edge; a second leaf pivotally mounted on the first leaf adjacent the leading edge of the second leaf and extending downstream approximately to the termination of the first leaf; each leaf including ramp means extending in a direction from the leading toward the trailing edge of the leaf, the ramp means on the second leaf being oblique to that on the first leaf so that movement of a driving means along the ramp means rotates the first leaf around its pivotal mounting and rotates the second leaf around its pivotal mounting on the first leaf so as to vary the relative angle of the leaves, thus varying the dimensional parameters of each said diffusing passage; the actuating ring including driving means in engagement with the said ramp means.

3. A variable-configuration diffuser for a radial gas compressor comprising, in combination, means providing mutually spaced radial walls defining between them an annular space for diffusion of flow from a compressor rotor to an outlet; an annular cascade of variable-configuration vanes each extending between the said walls and extending downstream from a leading edge adjacent the entrance to the said space and defining diverging diffusing passages between adjacent vanes; and an actuating ring encircling the axis of the diffuser operatively connected to the vanes and movable to vary the configuration of the vanes and thus the dimensional parameters of the diffusing passages, in which the improvement comprises a structure of each vane including a first leaf extending downstream from the vane leading edge pivotally mounted on the said first recited means adjacent the vane leading edge for swinging about a spanwise-extending axis; a second leaf pivotally mounted on the first leaf adjacent the leading edge of the second leaf for swinging about a spanwise-extending axis, the second leaf extending downstream approximately to the termination of the first leaf; and means for connecting the actuating ring to each of said first and second leaves such that movement of the actuating ring swings all the leaves concurrently about their spanwise-extending axes to vary the setting of the vanes and swings the second leaves relatively to the first leaves to vary the thickness of the vanes to optimize the diffuser exit to inlet ratio by changing both the direction of flow through the diffuser passage and the divergence of the passage

4. A variable-configuration diffuser for a radial gas compressor comprising, in combination, means providing mutually spaced radial walls defining between them an annular space for diffusion of flow from a compressor rotor to an outlet; an annular cascade of variable-configuration vanes each extending between the said walls and extending downstream from a leading edge adjacent the entrance to the said space and defining diverging diffusing passages between adjacent vanes; and an actuating ring encircling the axis of the diffuser operatively connected to the vanes and rotatable about the diffuser axis to vary the configuration of the vanes and thus the dimensional parameters of the diffusing passages, in which the improvement comprises a structure of each vane including a first leaf extending downstream from the vane leading edge pivotally mounted on the said first recited means adjacent the vane leading edge for swinging about a spanwise-extending axis; a second leaf pivotally mounted on the first leaf adjacent the leading edge of the second leaf for swinging about a spanwise-extending axis, the second leaf extending downstream approximately to the termination of the first leaf; and means for connecting the actuating ring to each of said first and second leaves such that rotation of the actuating ring swings all the leaves concurrently about their spanwiseextending axes to vary the setting of the vanes and swing the second leaves relatively to the first leaves to vary the thickness of the vanes to optimize the diffuser exit to inlet ratio by changing both the direction of flow through the diffuser passage and the divergence of the passage.

* * * * *